United States Patent [19]

Canova

[11] 3,989,646

[45] Nov. 2, 1976

[54] SYNTHETIC LAVANDIN OIL

[75] Inventor: Levy A. Canova, Jacksonville, Fla.

[73] Assignee: SCM Corporation, New York, N.Y.

[22] Filed: Jan. 29, 1971

[21] Appl. No.: 111,156

Related U.S. Application Data

[63] Continuation-in-part of Ser. No. 772,026, Oct. 30, 1968, abandoned.

[52] U.S. Cl. ..... 252/522

[51] Int. Cl.[2] ..... C11B 9/00

[58] Field of Search ..... 252/522

[56] References Cited

FOREIGN PATENTS OR APPLICATIONS 1,538,795 7/1968 France ..... 252/522

OTHER PUBLICATIONS

*Chemical Abstracts*, vol. 49, (1955), 10588b.

*Soap, Perf. & Cos.* vol. 27, (1954) pp. 169–176.

*J. Agr. Food Chem.*, vol. 15, No. 6, Nov.–Dec. 1967, pp. 1063–1067.

*Primary Examiner*—Frederick E. Waddell

*Attorney, Agent, or Firm*—Thomas M. Schmitz

[57] ABSTRACT

This application sets forth a synthetic lavandin oil composition having a distinct and pleasant lavandin-like fragrance which comprises linalool and linalyl acetate, the major fraction of which is substantially optically inactive and a sufficient proportion of methyl n-hexyl ether for imparting said distinct and pleasant lavandin-like fragrance.

3 Claims, No Drawings

SYNTHETIC LAVANDIN OIL

This application is a continuation-in-part of my copending application, having Ser. No. 772,026 filed Oct. 30, 1968, now abandoned, relating to a lavandin oil substitute. The copending earlier filed Application is the parent of this Application, and therefore, the subject matter of the earlier copending Application is incorporated by reference.

Natural lavandin oil (for example, from lavandin abrialis) because of its desirable fragrance, is useful in making perfumery products. It is suitably compounded with other fragrant materials for perfuming the person, or making perfumed products such as cosmetics, paper, soap, sprays, and the like.

Heretofore, perfume chemists have made synthetic lavandin oil compositions primarily to eliminate the high costs incurred in obtaining the natural lavandin oil product due to cultivation and processing costs. Another reason is that the fragrance of the natural lavandin oil varies from season to season. The first step of the perfume chemist was to analyze the natural lavandin oil for composition; and secondly, formulate the compounds found in the natural lavandin oil in a proportion similar to what are found in the natural oil. However, the synthetic lavandin oil compositions formulated to date, have had an unacceptable fragrance as a substitute. Typically, the note was significantly weaker and unlike that of the natural lavandin oil.

Analyses of natural lavandin oil listing the compounds found therein and proportion thereof are found in the *Journal of Agriculture and Food Chemistry*, Volume 15, Number 6 issue November-December, 1967, pp. 1063–1069 and in the book, *The Essential Oils* by Guenther, Volume 3, published by D. Van Nostrand Co., 1949, pp. 500–503.

On the other hand, my analyses of natural lavandin oil disclosed the presence of methyl n-hexyl ether in a proportion of about 0.1%. This compound had not been disclosed in the analyses of the references cited above. This discovery was very important because it was found that synthetic lavandin oil compositions containing linalool and linalyl acetate were substantially improved and possessed a noticeable and distinct lavandin-like fragrance when methyl n-hexyl ether was incorporated into the synthetic composition.

The synthetic lavandin oil composition of this invention contains a sufficient proportion of methyl n-hexyl ether preferably, about 0.1 weight percent in the synthetic composition. By a "sufficient proportion", it is meant that the methyl n-hexyl ether is present in a sufficient amount, so that the scent of the synthetic composition has a distinct and pleasant lavandin-like fragrance. Broadly, the proportion is between 0.01 to 1%, but as stated, the preferred proportion is about 0.1% by weight of the composition.

The synthetic lavandin oil composition of this invention also must contain linalool and linalyl acetate, the major fraction of which is substantially optically inactive. Typically, all of the linalool and linalyl acetate employed in the synthetic composition is optically inactive. By "substantially optically inactive", it is meant that the specific rotation of the linalool and linalyl acetate is not more than plus or minus 0.1°. Generally, the degree of rotation of each of the components; i.e., linalool and linalyl acetate is 0° as the linalool and linalyl acetate is racemic; i.e., containing about a 50—50 mixture of the respective d and l isomers. Natural lavandin oil, on the other hand, contains optically active linalool and linalyl acetate, as is shown in the Guenther publication at page 501. The specific rotation $[\alpha]_D^{20}$ is reported to be 20° – 21 minutes for natural linalool and linalyl acetate.

Like natural lavandin oil, the major proportion of the preferred synthetic composition is linalool and linalyl acetate. Preferably, the proportion of the two is between about 55–65% by weight of the composition. Typically, the linalool predominates over the linalyl acetate, and in preferred compositions, the weight percent linalool is between about 35–45% and the linalyl acetate is present in a proportion between about 18–25% by weight.

Advantageously, other components found in natural lavandin oil are incorporated into the synthetic lavandin oil composition in proportions approximating that in the natural oil. As might be expected, they tend to make the fragrance more like that of the natural lavandin oil. Typically, a synthetic lavandin oil composition will contain a lesser number of the ingredients found in the natural oil usually anywhere from about 10–60 of these compounds, whereas the natural contains from 75–95compounds. Trans-β ocimene is one compound which, when combined in a proportion of about 2–4% by weight of the composition, assists in achieving such desired fragrance.

Linalool and linalyl acetate, which are substantially optically inactive, can be prepared by techniques known in the art. One of the methods of preparing a synthetic linalool and linalyl acetate which is substantially optically inactive is by pyrolizing β-pinene to form myrcene, then reacting the myrcene with hydrochloric acid to form linalyl chloride, converting the linalyl chloride to linalyl acetate by reacting with sodium acetate, and then converting linalyl acetate to linalool by reacting with an alkali metal hydroxide. Variations of this process for making linalool and linalyl acetate having substantially no optical activity are found in U.S. Pat. Nos. 2,871,271 3,062,874, and 3,062,875 and such processes are incorporated by reference.

EXAMPLE I

A substitute for lavandin abrialis was compounded of the following thirty-eight ingredients in the percentage listed by blending the same at room temperature:

| COMPOUND | Wt. % | Degree of Specific rotation |
|---|---|---|
| Linalool, substantially optically inactive | 38.02 | Not greater than ± 0.1% |
| Linalyl Acetate, substantially optically inactive | 22.77 | Not greater than ± 0.1% |
| d-Camphor | 8.14 | |
| 1.8 Cineole | 8.14 | |
| 1-Borneol $\alpha_D$(obs.) = 18.5 (10% Isoborneol) | 3.67 | |
| β-Caryophyllene | 2.49 | |
| α-Pinene | 2.35 | |
| Trans-β Ocimene | 2.15 | |
| α-Terpineol | 2.06 | |
| 1-Limonene | 2.01 | |
| 3-Octanone | 1.16 | |
| Geranyl Acetate | 0.760 | |
| Benzyl Alcohol | 0.618 | |
| Myrcene | 0.587 | |
| Camphene | 0.577 | |
| β-Pinene | 0.506 | |

-continued

| COMPOUND | Wt. % | Degree of Specific rotation |
|---|---|---|
| 1-Octen-3-ol | 0.506 | |
| Hexyl Butyrate | 0.456 | |
| Hexyl Acetate | 0.353 | |
| 1-Octen-3-yl Acetate | 0.323 | |
| Terpinolene | 0.303 | |
| Hexyl Isobutyrate | 0.232 | |
| Hexanol | 0.202 | |
| Hexyl-2-methyl-butyrate | 0.202 | |
| 3-Octanol | 0.192 | |
| Linalool Oxide (cis, trans) | 0.192 | |
| p-Cymene | 0.181 | |
| Hexyl Isovalerate | 0.162 | |
| Dodecyl Alcohol | 0.152 | |
| Geraniol | 0.122 | |
| Methyl n-Hexyl Ether | 0.101 | |
| Hexyl Propionate | 0.096 | |
| Nerol B | 0.086 | |
| Acetone | 0.051 | |
| Benzyl Acetate | 0.032 | |
| Tetradecyl Alcohol | 0.025 | |
| 2-Methyl-3-Buten-2-ol | 0.015 | |
| Cuminaldehyde | 0.008 | |

The substitute or "synthetic" lavandin oil had the following constants: Refractive Index (20° C.) of 1.4614; Density (25° C.) of 0.8818; and Optical Rotation (25° C.) of +1.28.

The substitute compared favorably for fragrance and perfumery work with a natural lavandin abrialis (lavandin oil) which was analyzed as having at least 75 ingredients.

The natural lavandin abrialis had Refractive Index at 20° C. of 1.4643, density at 25° C. of 0.8857, and optical rotation at 25° C. of −4.10°, said material being very slightly higher in refractive index than the standards of the Essential Oil Association, but meeting the density and optical rotation standards of this Association. The substitute lacked a fishy, metallic note that was quite prominent in such natural lavandin abrialis.

EXAMPLE II

Four synthetic lavandin oil compositions were compared with natural lavandin abrialis for the purpose of determining the similarity of the fragrance between the synthetic composition and the natural.

Synthetic lavandin oil Composition A contains substantially optically inactive linalool and linalyl acetate, the linalyl acetate being present in a proportion of 37.4%, the balance being linalool.

Synthetic lavandin oil Composition B contains 96.6% of synthetic lavandin Composition A, and 3.4% trans-$\beta$ ocimene.

Synthetic lavandin oil Composition C contains 99.9% of synthetic lavandin Composition A, plus 0.1% methyl-n-hexyl ether.

Synthetic lavandin oil Composition D contains 99.9% of synthetic lavandin Composition B, plus 0.1% methyl-n-hexyl ether.

Composition A exhibited a very weak note, and its fragrance was substantially unlike that of the natural lavandin abrialis. Composition B containing 3.4% trans-$\beta$ ocimene, which is slightly higher proportion than is found in natural lavandin oil, did not possess a fragrance like that of the natural lavandin abrialis. On the other hand, Composition C containing 0.1% methyl-n-hexyl ether, exhibited a fragrance very similar to that of natural lavandin abrialis. Composition D exhibited a fragrance closest to that of natural lavandin abrialis, but the fragrance was not significantly different from that of Composition C.

The above Examples are provided to illustrate preferred embodiments of the invention, and are not intended to restrict the scope, thereof. All percents are weight percentages.

What is claimed is:

1. In a synthetic lavandin oil composition having a distinct and pleasant lavandin-like fragrance, said composition containing by weight between about 35 to 45% linalool, 18to 25% linalyl acetate, and natural lavandin oil ingredients other than methyl-n-hexyl ether, the improvement which comprises:

employing as a major portion of said linalool and linalyl acetate the substantially optically inactive form thereof having a specific rotation not more than ± 0.1°, and including in said composition between about 0.1 to 1% by weight of methyl-n-hexyl ether.

2. The composition of claim 1 wherein said methyl-n-hexyl ether is present in the synthetic lavandin oil composition in a proportion of about 0.1% by weight.

3. The composition of claim 1 containing from about 2 to 4% by weight of trans-$\beta$ ocimene.

* * * * *